US006718568B1

(12) United States Patent
Hensley

(10) Patent No.: US 6,718,568 B1
(45) Date of Patent: Apr. 13, 2004

(54) MODULAR FAUCET ASSEMBLY

(76) Inventor: Donald L. Hensley, 3445 Gulling Rd., Reno, NV (US) 89503

( * ) Notice: Subject to any disclaimer, the term of this patent is extended or adjusted under 35 U.S.C. 154(b) by 0 days.

(21) Appl. No.: 10/259,440

(22) Filed: Sep. 30, 2002

(51) Int. Cl.[7] ..... E03C 1/04

(52) U.S. Cl. ..... 4/675; 4/676; 4/677; 4/678; 4/695; D23/238; D23/239; D23/243

(58) Field of Search ..... 4/675, 676, 677, 4/678, 695; D23/238, 239, 243

(56) References Cited

U.S. PATENT DOCUMENTS

| | | | | |
|---|---|---|---|---|
| 2,302,097 | A | * 11/1942 | Beckman | 134/88 |
| 3,080,570 | A | * 3/1963 | Weddendorf | 4/192 |
| 3,571,821 | A | 3/1971 | Kaiser | |
| 3,623,638 | A | 11/1971 | Henning et al. | |
| 4,625,896 | A | 12/1986 | Rocchelli | |
| 4,650,470 | A | 3/1987 | Epstein | |
| 4,671,316 | A | 6/1987 | Botnick | |
| 5,073,991 | A | * 12/1991 | Marty | 4/678 |
| 5,114,048 | A | 5/1992 | Minke | |
| D341,875 | S | * 11/1993 | Allen et al. | D23/238 |
| 5,465,749 | A | 11/1995 | Sauter et al. | |
| 5,660,203 | A | 8/1997 | Gnauert et al. | |
| 5,822,811 | A | 10/1998 | Ko | |
| 5,906,319 | A | 5/1999 | Crowl | |
| 6,000,626 | A | 12/1999 | Futo et al. | |
| 6,202,686 | B1 | * 3/2001 | Pitsch et al. | 137/597 |
| 6,370,712 | B1 | 4/2002 | Burns et al. | |

FOREIGN PATENT DOCUMENTS

| | | |
|---|---|---|
| WO | 81/00251 | 2/1981 |
| WO | 00/45071 | 8/2000 |

* cited by examiner

*Primary Examiner*—Henry Bennett
*Assistant Examiner*—Azy Kokabi
(74) *Attorney, Agent, or Firm*—Richard C. Litman

(57) ABSTRACT

A modular faucet assembly is configured for installation upon a conventional sink top having left and right hot and cold water control valve passages and a central faucet assembly passage. The present modular assembly includes a single, central faucet and mixer control valve, with all water lines extending through the central sink top passage and the left and right sink top passages remaining free of any water supply lines. The present assembly makes use of these otherwise unused passages by having left and right faucet base passages which align with the corresponding sink top passages, and serve to secure the faucet assembly to the sink top and accept various accessories removably installed therein. The accessories may comprise a liquid soap dispenser pump, a retractable spray nozzle, or other device(s) as desired. A cap(s) may be installed at the accessory passage(s) when no accessory or accessories are installed.

10 Claims, 3 Drawing Sheets

MODULAR FAUCET ASSEMBLY

BACKGROUND OF THE INVENTION

1. Field of the Invention

The present invention relates generally to plumbing fixtures and the like, and more specifically to a faucet assembly for installation with a conventional bathroom or other sink, which permits different accessories to be installed with the faucet. The present modular faucet assembly includes a single central faucet and control valve, with the opposite left and right ends of the fixture attaching to the conventional valve passages of the sink. Different accessories, such as a liquid soap dispenser pump and a retractable spray nozzle, may then be installed through each end of the modular assembly, or the end passages may be capped as desired.

2. Description of the Related Art

Plumbing and water supply systems have long provided for both hot and cold water at various points in a structure, e.g., kitchen, bathroom, laundry, etc. Traditionally, the hot and cold water supply faucet or fixture comprised a single faucet with two separate hot and cold water control valves. In both cases, the sink, countertop, etc. to which such a system is affixed, requires a central passage for the single handle faucet, as well as separate passages to each side thereof for the hot and cold water controls as required/needed for two handle faucets.

A later development was the single control valve for controlling both hot and cold water flow from a single central faucet or spigot. Such valves may comprise a lever handle, or alternatively a ball-shaped or otherwise configured control. While various principles of operation are used, they all provide the same general function, i.e., the use of a single control and mixer unit for controlling both hot and cold water flow from a single faucet.

Such single control units are plumbed by connecting the hot and cold water supply lines to the input fittings in the base of the control, with all water supply lines either passing through the single central opening in the back of the sink or countertop, or through the sink openings to the left and right of the central opening. Thus, the additional two openings provided conventionally for separate hot and cold water control valves are not needed for such single valve systems, and must be capped or concealed in some manner.

However, many sink installations are provided with additional convenience features, such as liquid soap dispenser pumps, separate spray nozzles and flexible water supply lines therefor, etc. Each of these additional convenience features requires an additional hole or passage in the sink back or countertop. As these features may or may not be desired in any given installation, their installation requires a custom made, or at least custom modified, sink or countertop in order to accommodate these various accessories. Yet, practically all sinks include the additional passages for separate hot and cold water control valves, even though they are not necessarily needed when a fixture using a single central control valve is installed.

The present invention provides a solution to the above problem, by providing a single modular water supply fixture having a single central faucet and single control valve which serves to control the quantity of both hot and cold water, and mix the two, using a single valve. Such devices are well known, as indicated in the discussion further above. Conventionally, such devices attach to the conventional sink passages to each side of the central passage, using fittings to each end of the assembly. The ends of the device do not include any plumbing components, and serve only as attachment points for securing the device to the underlying sink or countertop, or as openings for the hot and cold supply for the faucet.

The present invention also includes left and right passages to each side of the central faucet and control valve, which align with the conventional passages provided in the standard sink back or countertop. The present modular faucet assembly thus allows other accessories, such as liquid soap dispensing pumps and spray nozzles with their flexible supply lines, to be installed through the left and right passages of the device and through the corresponding passages in the standard sink or countertop. These accessory attachment passages also serve as anchor points for securing the fixture to the underlying sink or countertop. Thus, the sink or countertop need not be customized or modified for the inclusion of such additional features, when the present invention is used.

A discussion of the related art of which the present inventor is aware, and its differences and distinctions from the present invention, is provided below.

U.S. Pat. No. 3,571,821 issued on Mar. 23, 1971 to Jack N. Kaiser, titled "Plumbing Fixtures," describes various embodiments of a specially configured sink to which a single control faucet and other accessories (liquid soap dispenser, drain closure lever, etc.) may be installed. One embodiment is relatively complex, including various dispensers, electrically powered accessories, etc. However, each of the Kaiser embodiments requires a specially manufactured and configured sink, with the sink including a rearwardly disposed pylon to which the other fittings are installed. While Kaiser notes that one can change the fittings and accessories of his assembly by changing the escutcheon atop the sink pylon, the fact remains that Kaiser requires a specially configured sink for installing his fixtures in the first place. In contrast, the present invention comprises a specially configured faucet assembly, which provides for installation on an existing conventional sink and which allows different accessories to be installed therewith, without need to replace an escutcheon or any of the plumbing or sink components. The present invention is thus considerably more versatile and economical than the Kaiser fixture.

U.S. Pat. No. 3,623,638 issued on Nov. 30, 1971 to Sabine Henning et al., titled "Liquid Dispenser For Shower Bath," describes an add-on assembly comprising a wall mounted liquid soap tank connected to a dispenser which is removably attached to the shower nozzle. The Henning et al. device has no provision for attaching to a sink, and cannot serve as a mounting point for a faucet assembly and other accessories, as does the present fixture.

U.S. Pat. No. 4,625,896 issued on Dec. 2, 1986 to Gianpaolo Rocchelli, titled "Device For Dispensing Liquid Soap," describes an add-on soap dispenser for attachment to an existing faucet assembly. The Rocchelli device fits around the base of the faucet, and requires that the faucet be at least loosened and raised from its attachment to the underlying escutcheon or plate, in order to install the Rocchelli device beneath the edges thereof. The Rocchelli device is relatively limited in comparison to the present invention, as Rocchelli provides only a soap dispenser which attaches to an existing sink faucet. In contrast, the present modular assembly provides a new faucet and control, which includes means for attaching various other fixtures thereto or capping and concealing the attachment points, as desired.

U.S. Pat. No. 4,650,470 issued on Mar. 17, 1987 to Harry Epstein, titled "Portable Water-Jet System," describes various embodiments of an assembly which attaches to an existing water faucet or tap. The Epstein assembly essentially comprises a diverter valve which threads to the end of the faucet, a solution mixing container, and a flow control valve. The Epstein assembly provides only the relatively limited function of diverting water flow from the faucet, mixing a substance therewith, and dispensing the water and substance mix. Epstein does not provide any structure for attachment to an existing water supply system, which structure allows the modular installation of various accessories therewith as desired, as does the present modular faucet assembly invention.

U.S. Pat. No. 4,671,316 issued on Jun. 9, 1987 to Irlin H. Botnick, titled "Faucet Manifold," describes a fixture having a base formed of stamped components, rather than being conventionally cast. The Botnick fixture is adapted for use with a plumbing system having separate hot and cold water control valves, with the hot and cold water lines extending to respective valves to each side of the central faucet, rather than being connected to a single central mixer valve, as in the present modular faucet assembly. As the Botnick fixture utilizes the left and right openings in the back of the sink or countertop for the water supply lines to pass therethrough, he cannot provide for the modular installation or replacement of other accessories in those openings, as provided for by the present invention.

U.S. Pat. No. 5,114,048 issued on May 19, 1992 to Robert M. Minke, titled "Faucet Assembly Having Integral Liquid Product Dispenser," describes an assembly which makes use of the space to each side of a single mixer control valve and faucet unit, by incorporating a liquid soap and/or lotion dispenser to each side thereof. However, the Minke assembly also requires that the dispensing lines from the two dispensers extend to the water outlet end of the faucet, where the soap or lotion is dispensed. The Minke unit is thus relatively limited in function, as it cannot be adapted for the installation of a retractable spray nozzle on a flexible hose, as can the present modular assembly. Moreover, Minke does not provide for the capping of one or both sides of his assembly if the dispenser(s) is/are not needed.

U.S. Pat. No. 5,465,749 issued on Nov. 14, 1995 to Bruce M. Sauter et al., titled "Top Mounting Faucet Assembly," describes an assembly having a top plate with anchor fingers extending therebelow. Tightening threaded fasteners from the top of the plate, locks the fingers against the underlying structure. Sauter et al. provide for an embodiment having a single central faucet and mixer control valve, as is used in the present assembly as well. However, Sauter et al. route the water supply lines through the left and right openings in the underlying structure, and through a manifold within the single control valve embodiment. This precludes the use of the openings to each side of the single faucet, for any purpose other than water line connections. Thus, Sauter et al. cannot provide any other accessories with their faucet assembly.

U.S. Pat. No. 5,660,203 issued on Aug. 26, 1997 to Werner Gnauert et al., titled "Deck-Mount Mixing-Faucet Assembly," describes a single valve, single faucet assembly which mounts to the underlying surface through a single hole or passage provided therethrough. Gnauert et al. provide a specific threaded mounting structure to secure their faucet assembly to the top of the surface, by securing it with a threaded fastener from beneath. Gnauert et al. do not disclose any additional holes or passages to either side of the single passage disclosed, and thus cannot add any other components laterally to their faucet assembly, as is provided by the present modular faucet assembly.

U.S. Pat. No. 5,822,811 issued on Oct. 20, 1998 to Hsi-Chia Ko, titled "Extensible Faucet Structure Of Kitchen Cabinet," describes an assembly having a single faucet and mixer control valve. Ko provides a sprayer extension from the faucet spigot, with the extension being connected to the mixer valve by a flexible hose or line which passes concentrically through the faucet nozzle or outlet, rather than from a separate fitting on the fixture body, as in the case of the present invention. Ko cannot provide additional accessories to either side of the central faucet and control valve, as he utilizes those areas for attaching the assembly to the underlying sink or countertop structure. Ko does not provide any through passages in these areas, for the installation of other accessories.

U.S. Pat. No. 5,906,319 issued on May 25, 1999 to Ronald D. Crowl, titled "Water/Soap Sprayer For Kitchen Faucets," describes a single faucet and mixer valve assembly having a mobile spray attachment with a separate soap supply. Two flexible hoses or lines connect the sprayer attachment respectively to the central mixer valve and to the soap supply container. Crowl provides a separate passage through the sink backboard or countertop for his spray attachment, and only a conventional faucet and mixer valve assembly for providing water flow to his spray attachment. No additional passages through the faucet body assembly or escutcheon are disclosed by Crowl, which precludes the installation of any accessories through the conventional passages in the sink top or countertop which are used with the present modular faucet assembly.

U.S. Pat. No. 6,000,626 issued on Dec. 14, 1999 to Dennis M. Futo et al., titled "Hand Operated Water Sprayer And Soap Dispenser," describes a combination device having a soap reservoir. Futo et al. do not disclose any means for mounting or attaching their sprayer to a sink, faucet assembly, or any other structure.

U.S. Pat. No. 6,370,712 issued on Apr. 16, 2002 to Leonard J. Burns et al., titled "Top Mount Plumbing Fixture," describes a specific structure for securing a plumbing fixture to a sink top or deck. The Burns et al. assembly uses a pair of projecting buttons which expand laterally after being pushed through the sink top opening. A threaded collar is then tightened to secure the assembly against the laterally projecting buttons. However, Burns et al. only disclose a two valve handle assembly, with the laterally opposed hot and cold water valves passing through the conventional passages in the sink top to either side of the central faucet. Accordingly, the Burns et al. assembly cannot provide for the modular installation of any other components therewith.

International Patent Publication No. 81/00,251 published on Feb. 5, 1981 to Domingos A. Bahi, titled "Automatic Three-Duty Faucet," describes an electrically powered system for supplying liquid soap and antiseptic at the single water faucet nozzle of the assembly. The containers for the various liquids are installed beneath the sink, and their supply lines extend upwardly through the single passage for the single faucet. No base with additional passages therein is disclosed by Bahi, and thus Bahi cannot provide for the installation of additional accessories with his system.

Finally, International Patent Publication No. 00/45,071 published on Aug. 3, 2000 to American Standard International, titled "Faucet With One-Piece Manifold Body," describes various embodiments of a faucet assembly having a single faucet and mixer valve control. American Standard discloses such a device with a spray attachment in FIGS. 17–23. However, the manifold portion of the American Standard assembly is laterally asymmetric, with one laterally extending branch which connects to one water line, and with the second water line connecting directly beneath the faucet and control valve. Only the overlying escutcheon of the assembly provides an appearance of symmetry, with the spray attachment extending upwardly from a hole or passage in the end of the escutcheon opposite the distal water line connection. The American Standard assembly cannot provide a truly modular installation, as no means is provided for installing anything other than a water line in one end of the device. In contrast, the present assembly is truly laterally symmetrical, with passages on each end providing for the installation of accessories therein as desired and with all water lines for the present assembly passing upwardly through the center hole of the sink or countertop to connect to the single central valve mechanism and faucet.

None of the above inventions and patents, taken either singly or in combination, is seen to describe the instant invention as claimed. Thus a modular faucet assembly solving the aforementioned problems is desired.

SUMMARY OF THE INVENTION

The present invention comprises a modular faucet assembly configured for installation upon a standard, conventional sink top or countertop having a series of three equally spaced passages therethrough. The conventionally located passages in such sinks and countertops comprise a center passage for a single central faucet or spigot and left and right passages for water control valves, with the left passage generally being used for the hot water valve and the right passage for the cold water valve. Where a single control valve is used, the water lines may be routed through the left and right passages and into the faucet assembly, or may be routed through the single central passage.

Where the water lines both pass through the single central passage, the two outlying passages are unused in conventional installations. The present invention makes advantageous use of this situation, by providing a modular faucet assembly which includes corresponding passages to each side of the central faucet and control valve. These faucet assembly passages are configured to align with the conventionally spaced sink or countertop passages (generally two inches apart on center in relatively smaller bathroom sinks, and four inches apart on center for larger kitchen, laundry, and other sinks). The corresponding passages through the sink or countertop and the present modular faucet assembly, provide for the installation of additional accessories or components, such as a liquid soap dispenser pump and/or retractable spray nozzle assembly, etc., as desired.

The concentric left and right passages of the present modular faucet assembly and its underlying sink or countertop, also facilitate attachment of the device to the sink or countertop. Concentric threaded fasteners may be used to secure the corresponding accessories in the assembly, as well as to secure the assembly to the countertop or sink. If installation of an accessory in both the left and right ends of the assembly is not desired, a decorative closure cap or cover may be installed in lieu of an accessory, at either or both ends of the device as desired.

Accordingly, it is a principal object of the invention to provide a modular faucet assembly having a single central faucet and mixer control valve therewith, and incorporating left and right accessory passages therewith which register with the conventional passages of a sink top or countertop when the present assembly is installed therewith.

It is another object of the invention to provide such a faucet assembly which includes at least one accessory installed in a corresponding one of the lateral passages of the assembly and underlying sink or countertop, with accessories such as liquid soap dispensing pumps and retractable spray nozzles being compatible with the present invention.

It is a further object of the invention to provide such a faucet assembly which may be configured for installation with a smaller bathroom sink having passages two inches apart on center, or with a larger kitchen or other sink having passages four inches apart on center.

Still another object of the invention is to provide at least one decorative closure cap or the like for closing any unused accessory passages, in the event that an accessory or accessories is/are not installed with the present modular faucet assembly.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a modular faucet assembly, for installation with a conventional sink or countertop having conventionally located passages for the water lines supplying the faucet assembly. Conventionally, such sinks and countertops are provided with a series of three passages through the horizontal rear portion thereof, adjacent to the back of the sink. These passages comprise a central water line passage through which the water lines extend from the left and right control valves to the faucet, and a left and a right passage to the respective sides of the central passage, through which the hot and cold water valves are installed, with the hot and cold water lines connecting to the respective valves at each side. Any additional accessories desired for installation in the sink or countertop require that additional holes or passages be formed through the sink or countertop, thus requiring custom work and precluding any changes to the final configuration due to the additional holes made.

With the development of faucet assemblies having a single, centrally disposed mixer control valve which not only controls the total flow rate of the hot and cold water, but also controls the mix of hot and cold water as well, the outlying left and right control valve passages are no longer needed for such in a conventional sink and countertop assembly. The present modular faucet assembly makes advantageous use of the existing conventional passages, by providing a faucet assembly having corresponding left and right passages in which various accessories may be installed.

Figure 1:
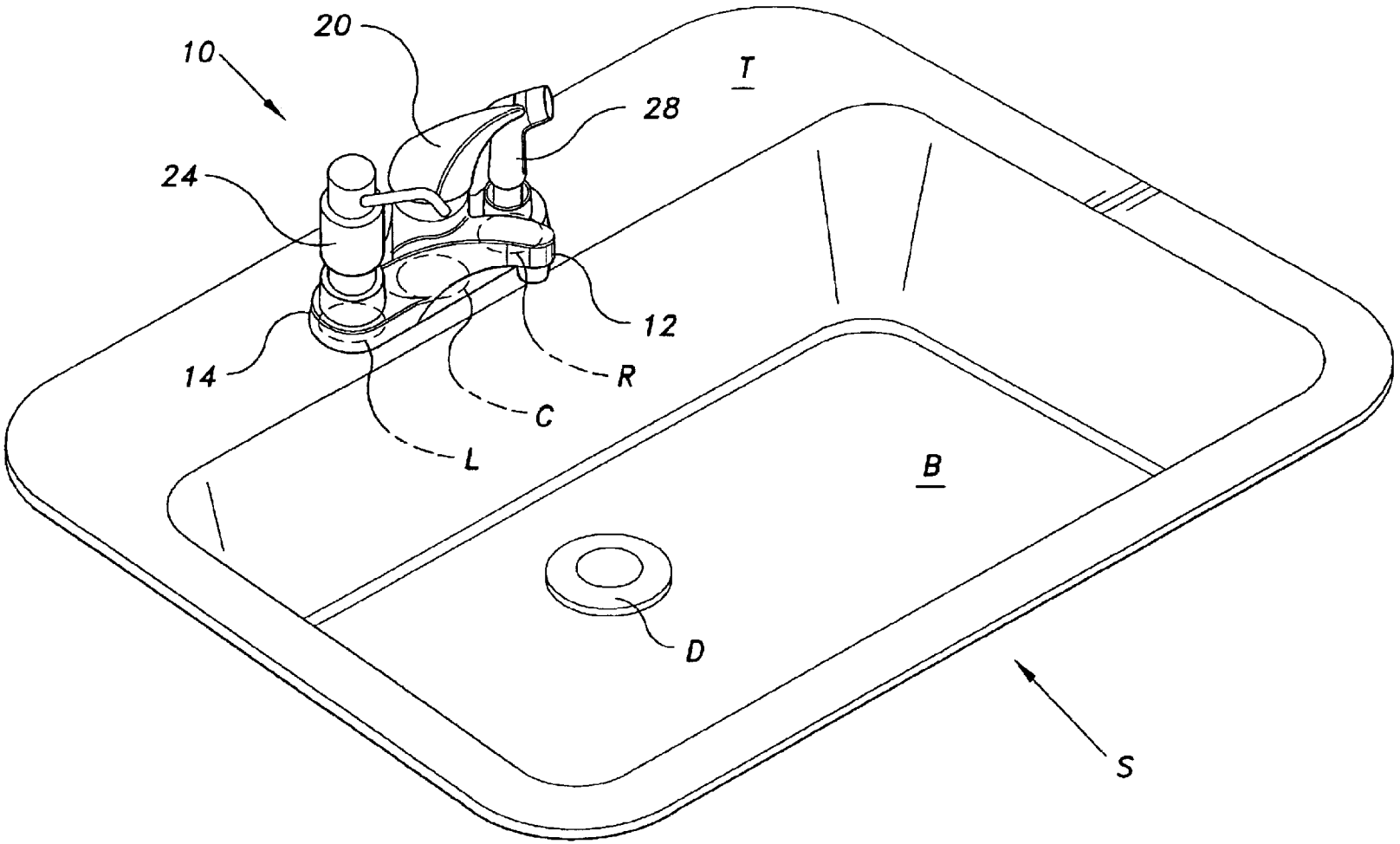
FIG. 1 is an environmental, perspective view of a modular faucet assembly and corresponding accessories according to the present invention.

FIG. 1 of the drawings provides a perspective view of the present modular faucet assembly 10 installed to a conventional sink S. The sink S includes a sink basin B with a generally flat, planar sink top T extending laterally from the upper edge of the sink basin B, primarily to the rear of the basin B. The rearwardly extending portion of the sink top T provides a mounting or attachment area for the present modular faucet assembly 10, or other faucet assembly. The rear portion of the sink top T conventionally includes a series of three holes or passages therethrough. The central passage C provides for the passage of hot and cold water lines therethrough to the single, centrally located faucet 12 of the faucet assembly 10, and the left and right passages L and R provides for the respective installation of hot and cold water control valves therein, in a conventional installation.

Figure 2:
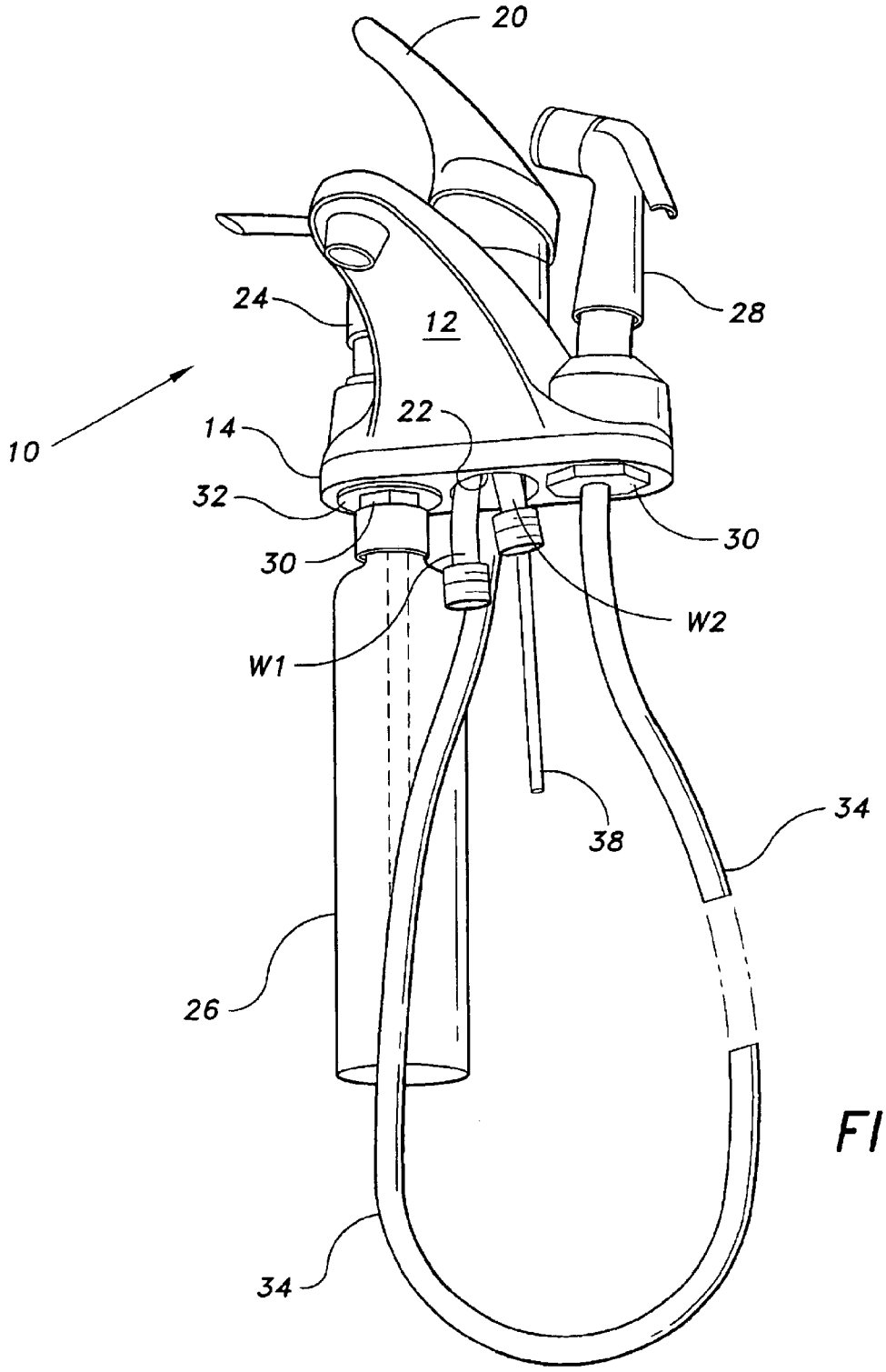
FIG. 2 is a bottom, front perspective view of the present modular faucet assembly, showing accessory and installation details thereof.

The installation of a faucet assembly having a single, central faucet and single, central mixer control valve, results in the left and right passages L and R being unused for water line installation. (In some fixtures, the water lines still extend through the left and right sink passages L and R, and connect to a manifold within the fixture, which conveys the water to the single central control valve.) In the present modular fixture 10, both the hot and cold water lines W1 and W2 extend through the central passage C, as indicated by their extension beneath the fixture 10 as shown in FIG. 2 of the drawings.

Yet, in many instances, consumers desire the installation of additional accessories (soap dispensers, spray nozzles, etc.) along the sink top. The installation of a conventional faucet assembly, even one with a single faucet and single central water control valve, requires that additional holes or passages be custom made in the sink top (or countertop) for the installation of such accessories, as the conventional faucet assembly does not include lateral passages therethrough which align with the left and right passages in the sink top to provide the required ports or passages for the installation of such accessories.

The present modular faucet assembly 10 provides a solution to this problem, by providing a laterally symmetrical faucet base 14 with additional, laterally disposed left and right accessory passages, respectively 16 and 18, to each side of the single, centrally disposed faucet 12 and mixer control valve 20 extending therefrom. A central water line passage 22 extends through the center of the base 14, for passage of the two water lines W1 and W2 therethrough to the conventional mixer control valve 20 located at the base of the faucet 12. The central water line passage 22 is shown clearly in the bottom and front perspective view of FIG. 2 of the drawings, with the left and right passages 16 and 18 being visible in FIG. 3. No manifold is required with the present modular assembly 10, as the water lines W1 and W2 are routed through the central passage C of the sink top T or countertop and through the corresponding central passage 22 of the modular assembly 10, when the assembly 10 is installed upon the sink top T.

The various passages 16, 18, and 22 of the present modular faucet assembly 10 are preferably spaced and configured to align with the conventional spacing of the corresponding passages L, C, and R of a conventional sink S having three such passages formed in the top T thereof. When the present faucet assembly 10 is installed atop the sink top T or countertop having such conventionally positioned passages therethrough, the holes or passages 16, 18, and 22 of the fixture 10 are in alignment and in registry with the corresponding holes or passages L, R, and C of the sink top T or countertop, where the present fixture is installed directly to a countertop. The left and right passages 16 and 18 provided through the ends of the fixture 10 and corresponding left and right passages L and R through the sink top T or countertop, permit the installation of any of a number of various accessories through both the present modular fixture 10 and the sink top T or countertop as desired, without any requirement for the formation of additional holes through the sink top T or countertop.

Examples of accessories which may be installed with the present modular faucet assembly 10, are illustrated in FIGS. 1 and 2 of the drawings. In FIGS. 1 and 2, a hand operated liquid soap dispenser pump 24 is installed through the left accessory passage of the faucet assembly 10, with a reservoir 26 extending downwardly beneath the sink top and through the left sink top passage L. The right sink top passage R and corresponding right accessory passage, have a retractable spray nozzle 28 installed therein.

FIG. 2 provides a view of the underside of the modular assembly 10, showing how the various accessories are installed thereto, and also showing the attachment fittings for installing the assembly 10 and any accessories therewith, to a sink top or countertop. In FIG. 2, a large diameter nut 30 and washer 32 are used to secure the upwardly extending soap dispenser pump 24 to the faucet base 14. The soap reservoir 28 threads onto a fitting extending from the bottom of the pump 24, which passes through the left passages L and 16 formed respectively through the sink top S and faucet base 14. The nut 30 and washer 32 are used to clamp the sink top T and/or countertop between the washer 30 and the underside of the faucet base 14, thereby locking the left end of the faucet base 14 to the sink top T or countertop.

A similar arrangement is used to secure the right side of the faucet base 14 to the sink top T or countertop, with a second large diameter nut 30 (which may be identical to the left side nut 30 for the soap dispenser pump 24) used to secure the mounting base for the spray nozzle 28. The nuts 30 have relatively large internal diameters, as do the various passages L, R, 16, and 18 of the sink top T and faucet base 14. This allows the flexible hose 34 of the spray nozzle 28 to be easily pulled through the right hand passages R of the sink top T and 18 of the faucet base 14, to allow a user to manipulate the device as desired. The spray nozzle hose 34 is secured conventionally to an outlet beneath the faucet base 14, with a conventional diverter valve (not shown) providing control for any water spray desired from the spray nozzle 28.

Figure 3:
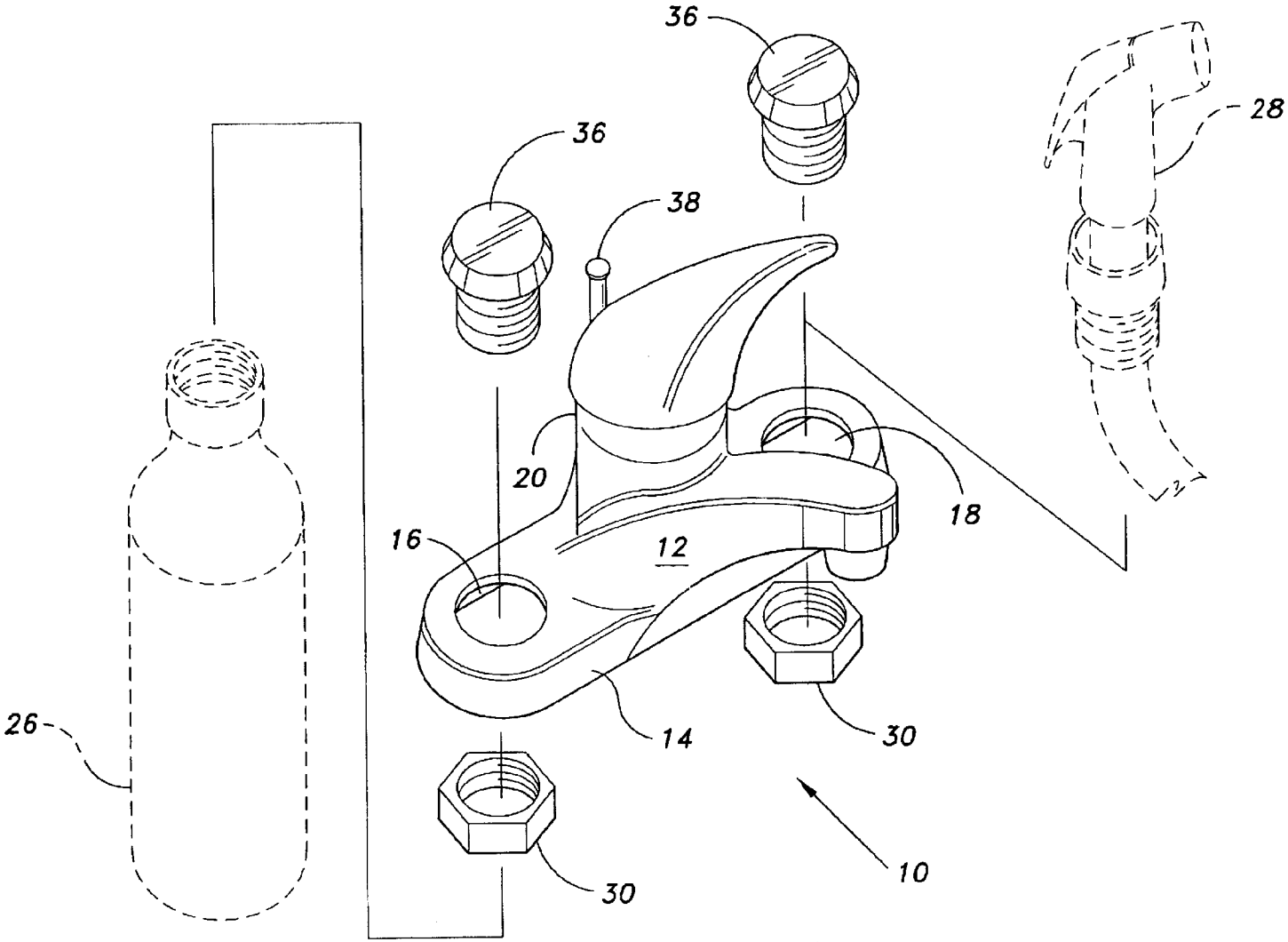
FIG. 3 is an exploded top, front perspective view of the present modular faucet assembly, showing the alternative installation of closure caps in place of accessory installation therewith.

Alternatively, it may be desired that either of the above described accessories be removed, or that neither be installed. Accordingly, a faucet base accessory passage closure cap 36 may be removably installed atop either or both ends of the faucet base 14 as desired, securing through the respective accessory passage 16 and/or 18. The accessory passage attachment fitting(s), e.g. retaining nut(s) 30, may be used to secure the corresponding closure cap 36 to the top of the faucet base 14, with the closure cap(s) 36 and corresponding nut(s) 30 serving to secure the faucet base assembly 14 to the sink top T or countertop as desired. FIG. 3 of the drawings illustrates this embodiment of the invention, with the liquid soap reservoir 26 and spray nozzle 28 shown in broken lines, removed from the faucet base 14 for installation of the faucet base accessory passage closure caps 36.

The present modular faucet assembly 10 may include other features conventionally found in single faucet and valve assemblies of the prior art. For example, a remotely actuated sink drain closure D may be installed in the bottom of the sink basin B, if so desired., as shown in, FIG. 1 of the drawings. A conventional actuating rod 38 extends upwardly from the back of the faucet 12 and control valve and lever 20, as shown in FIG. 3. The actuating rod 38 extends downwardly through the faucet assembly 14, as shown in FIG. 3, and through the sink top T or countertop to engage with a conventional drain closure actuator mechanism, e.g., lever, etc., which passes through the drain pipe below the drain D of FIG. 1 to lift and lower the drain closure D, as is known in the art.

The present modular faucet assembly 10 is particularly well suited for installation with a bathroom sink or the like, having sink top openings or passages L and R spaced two inches on center to each side of the central opening or passage C, i.e., the left and right passages L and R are spaced four inches apart on center from one another. Accordingly, a preferred embodiment of the present modular faucet assembly 10 has correspondingly spaced passages 16 and 18, spaced two inches on center to each side of the central passage 22. These respective left, center, and right passages 16, 22, and 18, and L, C, and R, align with one another when the faucet assembly 10 is placed atop the sink top T for installation thereto.

Alternatively, the present modular assembly 10 may be configured for installation upon a relatively larger kitchen or laundry sink, etc. Such sinks conventionally have their left and right passages spaced eight inches apart from one another, or four inches on center from the central passage. Oftentimes, a separate hole or passage must be provided in the sink top for the installation of a vent for a dishwasher drain line or the like. The present modular faucet assembly 10 allows such a drain line vent to be installed at one of the two left or right passages 16 or 18 of the faucet base assembly 14 and corresponding left or right sink top or countertop passage, without need to modify the sink top or countertop with an additional hole or passage therethrough. An accessory such as the liquid soap dispenser, which is not normally used in kitchen sink installations, may be omitted in such an installation. It will be seen that the spacing of the passages 16, 18, and 22 of the faucet base 14 of the present modular faucet assembly 14 is not critical, and may be arranged as desired to fit any given spacing of corresponding passages in any type of sink as desired.

In conclusion, the present modular faucet assembly provides a novel means for persons to customize a faucet and sink fixture as desired, without need for custom alteration of the sink or countertop with additional holes or passages therethrough. The user of the present invention may arrange the accessories in any order or arrangement desired, using a standard sink and sink top and/or countertop with its conventionally placed holes or passages for water lines, valves, fittings, etc. In the event that the user wishes to change the arrangement of the accessories, e.g. a spray nozzle attachment previously used for washing dishes which is removed for the installation of an automatic dishwasher drain vent, it is a relatively simple matter to disconnect the fittings as desired and reinstall the new fittings, using the same accessory holes or passages 16 and/or 18 in the same faucet base 14. The present invention enables consumers to retain the same faucet assembly 10 regardless of any changes in the accessories desired therewith. The present invention thus saves the consumer money, in that it is not necessary to purchase a different faucet assembly if accessories are changed, nor is it necessary to customize the sink top or countertop by forming additional holes therethrough, or closing previously formed holes.

If certain of the accessory passages of the present modular faucet assembly are not to be used, the closure caps provided as a part of the present invention enable the consumer to assemble the present device in place as desired, without need for the installation of undesired accessories. Accordingly, the present modular faucet assembly will prove to be very popular with homeowners, plumbing contractors, apartment managers, and any other persons who have need of standardization in the plumbing field and the corresponding savings in costs provided by such standardization.

It is to be understood that the present invention is not limited to the embodiments described above, but encompasses any and all embodiments within the scope of the following claims.

I claim:

1. A modular faucet assembly comprising:

a laterally symmetrical faucet base;

a single, centrally disposed water faucet extending from said faucet base;

a single, centrally disposed hot and cold water control valve extending from said faucet base;

said faucet base further including a central water line passage and a left and a right accessory passage therethrough;

a left and a right accessory passage attachment fitting concentrically disposed with the corresponding said left and right accessory passage, for securing said faucet base to an underlying structure; and at least one removably installable faucet base accessory passage closure cap.

2. The modular faucet assembly according to claim 1, further including at least one accessory for modular installation in a corresponding said accessory passage of said faucet base.

3. The modular faucet assembly according to claim 2, wherein said at least one accessory comprises a liquid soap dispenser pump.

4. The modular faucet assembly according to claim 2, wherein said at least one accessory comprises a retractable spray nozzle.

5. The modular faucet assembly according to claim 1, wherein said at least one faucet base accessory passage closure cap engages a corresponding said accessory passage attachment fitting for securing said faucet base to the underlying structure when said at least one faucet base accessory passage closure cap is installed upon said faucet base.

6. A sink in combination with a modular faucet assembly installed therewith, comprising:

a sink basin;

a generally flat, planar sink top extending at least rearwardly and laterally from said sink basi;

said sink top having a central water line passage and a left and a right accessory passage therethrough;

a laterally symmetrical faucet base;

a single, centrally disposed water faucet extending from said faucet base;

a single, centrally disposed hot and cold water control valve extending from said faucet base;

said base further including a central water line passage and a left and a right accessory passage therethrough;

said central water line passage, said left, and said right accessory passage of said faucet base aligning respectively with said central water line passage and said left and said right accessory passage of said sink top;

a left and a right accessory passage attachment fitting securing said faucet base to said sink top at said left and said right accessory passage of said faucet base and of said sink top; and at least one removably installable faucet base accessory passage closure cap.

7. The sink and modular faucet assembly combination according to claim 6, wherein said at least one faucet base accessory passage closure cap engages a corresponding said accessory passage attachment fitting for securing said faucet base to said sink top when said at least one faucet base accessory passage closure cap is installed upon said faucet base.

8. The sink and modular faucet assembly combination according to claim 6, wherein said left and said right accessory passage of said faucet base and of said sink top are spaced two inches on center to each side of the respective said central water line passage of said faucet base and of said sink top.

9. The sink and modular faucet assembly combination according to claim 6, wherein said left and said right accessory passage of said faucet base and of said sink top are spaced four inches on center to each side of the respective said central water line passage of said faucet base and of said sink top.

10. The sink and modular faucet assembly combination according to claim 6, further including:

a remotely actuated sink drain; and a drain closure actuator mechanism disposed through said faucet base, and communicating with said sink drain for selectively opening and closing said sink drain as desired.

* * * * *